US005537001A

United States Patent [19]

Clerc

[11] Patent Number: 5,537,001

[45] Date of Patent: Jul. 16, 1996

[54] FLAT VACUUM CHAMBERS WITHOUT PUMPING STEM

[75] Inventor: Jean-Frédéric Clerc, Saint Egreve, France

[73] Assignee: Pixtech S.A., Rousset, France

[21] Appl. No.: 413,345

[22] Filed: Mar. 30, 1995

[30] Foreign Application Priority Data

Mar. 31, 1994 [FR] France ..... 94 04086

[51] Int. Cl.[6] ..... H01J 9/26

[52] U.S. Cl. ..... 313/634; 228/121; 445/25; 445/43

[58] Field of Search ..... 313/634, 312, 313/317; 445/25, 43; 228/124.6, 121

[56] References Cited

U.S. PATENT DOCUMENTS

| | | | |
|---|---|---|---|
| 2,969,163 | 1/1961 | Roberts | 220/2.3 |
| 3,980,366 | 9/1976 | Przybylek | 445/25 |
| 4,018,374 | 4/1977 | Lee et al. | 228/124.6 |
| 4,070,749 | 1/1978 | Misono et al. | 445/25 X |
| 4,125,390 | 11/1978 | Kawai et al. | 65/34 |
| 4,182,540 | 1/1980 | Frankland et al. | 445/25 |
| 4,204,721 | 5/1980 | Hubert et al. | 445/25 |

FOREIGN PATENT DOCUMENTS 2924274 12/1979 Germany .

OTHER PUBLICATIONS

IBM Technical Disclosure Bulletin, vol. 27 No. 1B Jun. 1984 p. 625.

*Primary Examiner*—Kenneth J. Ramsey
*Attorney, Agent, or Firm*—Plevy & Associates

[57] ABSTRACT

A flat vacuum without pumping stem, for the manufacturing of display screens, comprises two plates made of glass, a sealing peripheral joint interrupted so as to provide an aperture for evacuation of the gases during manufacturing, a thin-film metallic pad disposed on each inner surface of the glass plates at the level of the aperture, and a sealing element made of metal having a low melting point disposed so as to contact the metallic pads.

10 Claims, 1 Drawing Sheet

FLAT VACUUM CHAMBERS WITHOUT PUMPING STEM

BACKGROUND OF THE INVENTION

1. Field of the Invention

The invention generally relates to the field of flat vacuum chambers constituting display screens, and more particularly to microtip chambers and plasma screens. More specifically, the invention relates to a method for manufacturing flat vacuum chambers without pumping stem, and the products obtained using this method.

2. Discussion of the Related Art

Such screens are generally constituted by a vacuum chamber made from two thin glass plates, in which a vacuum is generated by pumping through a pumping stem.

These screens are usually manufactured by conventionally depositing onto two glass plates the various elements constituting the cathode and the anode; assembling the two plates so as to face each other in their respective definitive position, with interposition of a sealing fusible joint at their periphery to form a vacuum chamber; generating a vacuum and maintaining it in the chamber while the latter is heated for degassing the components.

The last phase requires the provision, on one of the plates, of an exhaust tube, or pumping stem, to which an exhaust pipe is connected. When the vacuum conditions required for the application are satisfied (generation of a vacuum as satisfactory as possible in the case of microtips tubes, introduction of a gas in the case of plasma screens), the pumping stem is closed, generally by fusion, but an external protuberance still remains, which increases the thickness of the manufactured device. In addition, the pumping stem renders the plate on which it is positioned more fragile, and the plate requires special manufacturing, which increases the manufacturing cost. Moreover, particular care is required to handle and to store the plate and the screen. This technique requires two separate steps for manufacturing each screen, namely: pumping and closing the pumping stem.

SUMMARY OF THE INVENTION

The object of the present invention is to avoid the above-mentioned drawbacks. The method allows both the elimination of the pumping stem and a low-cost global step for manufacturing the screens.

The method consists of depositing a thin-film metallic pad on each of the internal surfaces of the two glass plates constituting the flat chamber, one of these plates having a peripheral joint which is interrupted at the level of the pad; placing the plates in an airtight chamber in which a vacuum is generated; and sealing the flat chamber by providing metallic balls having a low melting point in contact with the pads and raising the temperature beyond the melting point of the metal so that the melted metal penetrates through capillarity into the aperture of the peripheral joint, between the two metallic pads.

The foregoing and other objects, features, aspects and advantages of the invention will become apparent from the following detailed description of the present invention when taken in conjunction with the accompanying drawings.

DETAILED DESCRIPTION

Figure 1:
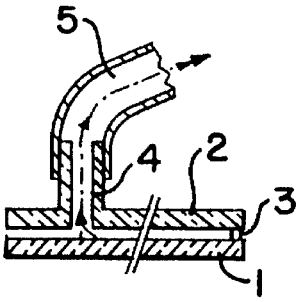
FIG. 1 illustrates the conventional method used for generating a vacuum in a flat screen.

The conventional method for mounting a flat display screen (refer to FIG. 1) consists of assembling two sheets or plates made of glass, 1 and 2, at their respective definitive position, then hot-sealing them with a fusible peripheral glass joint 3. One of the plates comprises a pumping stem 4 to which an exhaust pipe 5 is connected to generate a vacuum between the two plates. Once a vacuum is generated, the pumping stem is closed, generally by fusing.

The method according to the present invention comprises the three following steps:

First step: Preparing the substrates.

Figure 2:
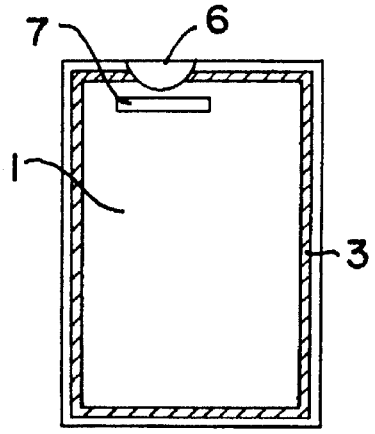
FIGS. 2 and 3 represent the glass plates constituting the flat chamber, seen from their inner surface.
Figure 3:
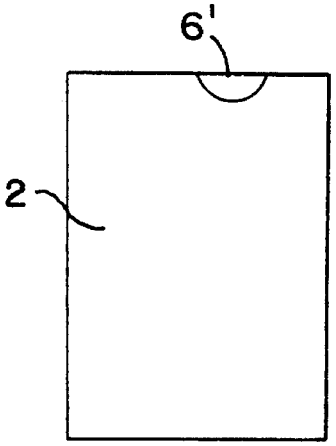

As represented in FIGS. 2 and 3, each glass plate 1 and 2 receives, near an edge of its inner surface, a thin-film metallic pad 6, 6', for example, a 500-Å chromium layer coated with a 1-μm nickel film.

One of the plates 1 supports a sealing wall 3 made of fusible glass or another suitable material, interrupted in front of the metallic pad.

One of the glass plates can support a thin-film getter 7.

Second step: Sealing with neutral gas.

Figure 4:
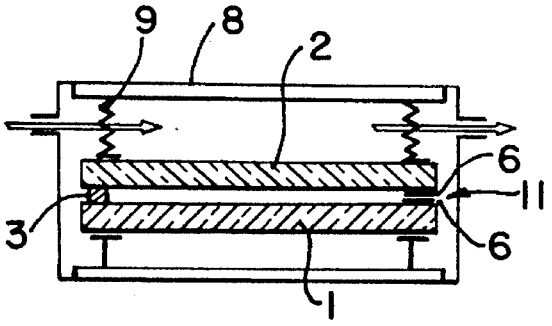
FIGS. 4 and 5 are cross-sectional views of vacuum chambers containing one and several flat chambers, respectively.

As represented in FIG. 4, the glass plates 1 and 2 are piled one over the other so that the pads 6 and 6' are facing each other; then, the plates are placed in a chamber 8 filled with a neutral gas, for example argon, at a pressure, generally the atmospheric pressure, slightly higher than the pressure at which the peripheral joint 3 made of fusible glass was prepared.

The plates are pressed together by a mechanic device 9 such as a spring or a jack, and heated up to the melting temperature of the sealing wall 3, the overpressure of argon preventing the wall from forming bubbles.

Once the fusible glass has flown and sticked with the two glass plates 1 and 2 the plates are cooled to the ambient temperature, while the argon pressure in chamber 8 is maintained.

Third step: Generating a vacuum and closing.

Figure 6:
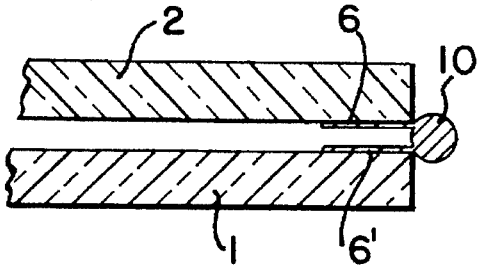
FIG. 6 is an enlarged partial cross-sectional view of a flat chamber immediately before closure of the aperture of the peripheral joint.

One or several elements 10, represented in FIG. 6, made of metal having a low melting point, for example including tin, are placed so as to contact the metallic pads 6 and 6', and the chamber 8 is evacuated. The gases trapped in the flat chamber during melting of the glass wall 3 are evacuated through the aperture 11 that is delineated by the pads 6 and 6' and the interruption of the peripheral joint 3.

Figure 7:
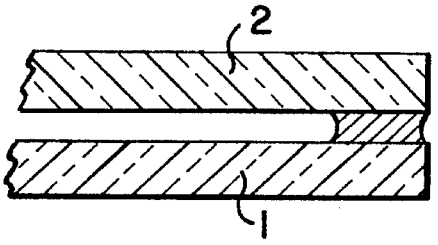
FIG. 7 is an enlarged partial cross-sectional view of the flat chamber after closure of the aperture.

The temperature inside the vacuum chamber is then raised beyond the melting temperature of the metal of the elements 10 (lower than 300° C.), but lower than the melting temperature of the fusible glass, so that the sealing wall 3 remains in solid state while the metal having a low melting temperature is liquified, wets the facing metal pads 6 and 6', and penetrates into the aperture 71 through capillarity, as represented in FIG. 7. Then, the temperature is decreased below the solidification point of the metal, thus closing the aperture.

The elements 10 made of metal having a low melting point can advantageously have the shape of balls.

Figure 5:
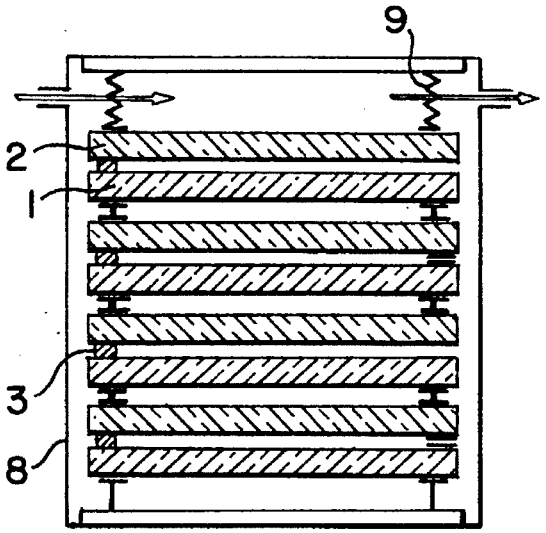

The whole operation for assembling and generating a vacuum for the flat chambers is carried out in a single vacuum chamber 8 that can contain several screens (refer to FIG. 5), without having to handle the screens. This simplifies the manufacturing and decreases the duration of manufacturing, resulting in a significant cost reduction.

Having thus described at least one illustrative embodiment of the invention, various alterations, modifications, and improvements will readily occur to those skilled in the art. Such alterations, modifications, and improvements are intended to be within the spirit and scope of the invention. Accordingly, the foregoing description is by way of example only and is not intended to be limiting. The invention is limited only as defined in the following claims and the equivalents thereto.

I claim:

1. A flat vacuum chamber without pumping stem for the manufacturing of display screens, comprising two plates (1, 2) made of glass, a peripheral sealing joint (3) interrupted so as to provide an aperture (11) for evacuation of the gases during manufacturing, a thin-film metallic pad (6, 6') disposed on an edge of each inner surface of the glass plates (1, 2), at the level of said aperture (11), and a sealing plug (10) made of metal having a low melting point disposed so as to contact the metallic pads (6, 6').

2. The flat vacuum chamber of claim 1, wherein the metallic pads (6, 6') are formed by a 500-Å chromium layer, coated with a 1-μm nickel film.

3. The flat vacuum chamber of claim 1, wherein one of the glass plates (1, 2) supports a thin-film getter (7).

4. A method or manufacturing flat vacuum chambers without pumping stem, for the manufacturing of display screens constituted by two plates (1, 2) made of glass that are sealed with a peripheral joint (3), including the following steps:

providing one of the plates (1, 2) with a peripheral joint (3) interrupted in order to form an aperture (11) for evacuating gases, depositing a thin-film metallic pad (6, 6') on an edge of the inner surface of each of the two glass plates (1, 2) at the level of said aperture, placing the glass plates (1, 2) one over the other so that the two metallic pads (6, 6') are facing each other, disposing the plates in a chamber (8) in which a vacuum is generated, and rendering the flat chamber airtight by providing one or more metallic elements (10) having a low melting point in contact with the metallic pads (6, 6') and raising the temperature beyond the melting point of the metallic elements (10) so that the melted metal penetrates through capillarity into the aperture (11) of the peripheral joint, between said two metallic pads.

5. The method of claim 4, wherein the peripheral joint (3) is made of a fusible glass, further comprising the following steps:

filling the vacuum chamber (8) with a neutral gas such as argon, at a pressure slightly higher than the preparation pressure of said peripheral joint, heating up to the melting temperature of the fusible glass, then cooling, generating a vacuum in said chamber (8), and rendering the flat chamber airtight by providing one or more metallic elements (10) having a low melting point in contact with the metallic pads (6, 6'), and raising the temperature beyond the melting point of the metallic elements (10) but below the melting point of the fusible glass of the peripheral joint (3).

6. The method of claim 4, wherein the metallic elements (10) having a low melting point are constituted by balls.

7. The method of claim 4, wherein the material constituting the elements (10) includes tin.

8. The method of claim 4, wherein the metallic pads (6, 6') are achieved by successively depositing a 500-Å chromium layer, coated with a 1-μm nickel film.

9. The method of claim 4, wherein the glass plates (1, 2) are pressed together in the vacuum chamber (8) with a mechanical device (9).

10. The method of claim 9 wherein said mechanical device is a spring or a jack.

* * * * *